US008197658B2

(12) United States Patent
Matsui et al.

(10) Patent No.: US 8,197,658 B2
(45) Date of Patent: Jun. 12, 2012

(54) HOLLOW ELECTRODE WITH FILM FOR ELECTRODEPOSITION COATING

(75) Inventors: Shouhei Matsui, Osaka (JP); Yasushi Yoshida, Osaka (JP); Nobuyoshi Shoji, Chiba (JP); Yukio Matsumura, Chiba (JP)

(73) Assignees: Daiso Co., Ltd., Osaka-shi (JP); AGC Engineering Co., Ltd., Chiba-shi (JP)

( * ) Notice: Subject to any disclaimer, the term of this patent is extended or adjusted under 35 U.S.C. 154(b) by 286 days.

(21) Appl. No.: 12/296,804

(22) PCT Filed: Apr. 13, 2007

(86) PCT No.: PCT/JP2007/058179

§ 371 (c)(1),
(2), (4) Date: Jun. 17, 2010

(87) PCT Pub. No.: WO2007/119824

PCT Pub. Date: Oct. 25, 2007

(65) Prior Publication Data

US 2010/0276280 A1 Nov. 4, 2010

(30) Foreign Application Priority Data

Apr. 14, 2006 (JP) ..... 2006-112005

(51) Int. Cl.
*C25B 9/10* (2006.01)

(52) U.S. Cl. ..... 204/630; 204/626; 204/627; 204/638; 204/639; 204/622; 204/224 R; 204/225; 204/252; 204/263; 204/283

(58) Field of Classification Search ..... 204/622, 204/626, 627, 630, 638, 639, 640, 224 R, 204/225, 252, 263, 283, 471, 480, 481, 516, 204/517, 518, 520, 521, 539
See application file for complete search history.

(56) References Cited

U.S. PATENT DOCUMENTS

| | | | | |
|---|---|---|---|---|
| 4,834,861 | A | 5/1989 | Inoue | |
| 5,584,981 | A | 12/1996 | Turner et al. | |
| 5,591,316 | A * | 1/1997 | Hess et al. | 204/482 |
| 5,827,416 | A * | 10/1998 | Brown et al. | 204/472 |
| 5,906,722 | A | 5/1999 | Foller et al. | |
| 7,108,772 | B2 * | 9/2006 | Legatski et al. | 204/252 |
| 2004/0069640 | A1 * | 4/2004 | Pizzamiglio et al. | 204/640 |
| 2007/0039825 | A1 * | 2/2007 | Hess et al. | 204/622 |

FOREIGN PATENT DOCUMENTS

| | | |
|---|---|---|
| JP | 64 31993 | 2/1989 |
| JP | 7 308548 | 11/1995 |
| JP | 2001 514956 | 9/2001 |

* cited by examiner

*Primary Examiner* — Bruce Bell
(74) *Attorney, Agent, or Firm* — Oblon, Spivak, McClelland, Maier & Neustadt, L.L.P.

(57) ABSTRACT

In order to solve various problems such as a reduction in a paint resin with the progress of electrodeposition coating treatment and remelting of a coating film or the occurrence of pinholes caused by an increased concentration of an electrolyte as a result of the reduction, upsizing of a hollow electrode with a membrane for electrodeposition coating combined with a barrier membrane (e.g., an ion exchange membrane) and an increase in the number of components should be avoided. In order to realize this, a barrier membrane 20 such as an ion exchange membrane is attached to the exterior surface of an electrode main body 10, which is in a hollow state made of a conductive material and configured so as to allow a liquid to pass through freely between the inside and outside of the electrode serving as a support.

11 Claims, 1 Drawing Sheet

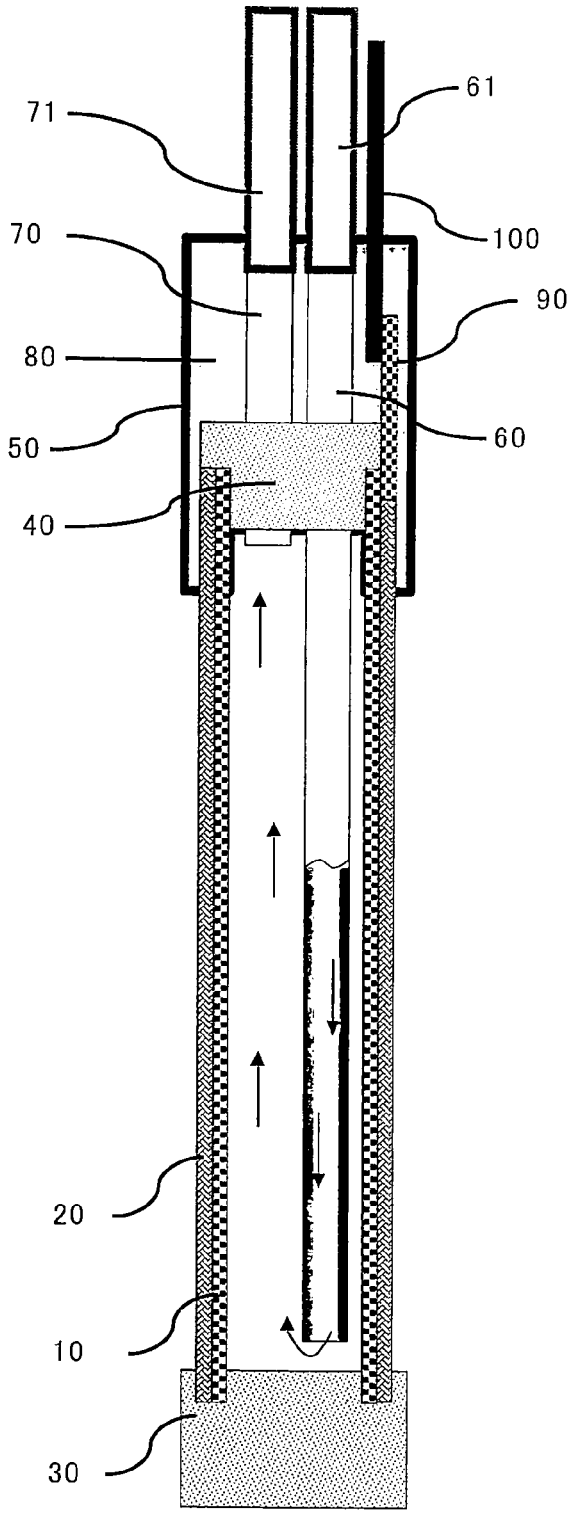
71
61
70
100
90
80
50
60
40
20
10
30

HOLLOW ELECTRODE WITH FILM FOR ELECTRODEPOSITION COATING

TECHNICAL FIELD

The present invention relates to a hollow electrode for use in electrodeposition coating for electrically coating with an electrically-charged paint. More specifically, the present invention relates to a hollow electrode with a membrane for electrodeposition coating combined with a barrier membrane (e.g., an ion exchange membrane), in order to solve various problems such as a reduction in a paint resin with the progress of electrodeposition coating treatment and remelting of a coating film and the occurrence of pinholes caused by an increased concentration of an electrolyte as a result of the reduction.

BACKGROUND ART

In electrodeposition coating, as is well known, electrodes are placed in an electrodeposition bath filled with a paint solution. Usually, the electrodes are arranged on both sides of the electrodeposition bath. Then, an object to be coated which is moved between the electrodes arranged in the electrodeposition bath serves as a counter electrode so that an electrically-charged paint resin contained in the paint solution is deposited on the surface of the substrate.

Such electrodeposition coating includes one using a cationic paint whose resin component is positively charged and one using an anionic paint whose resin component is negatively charged. The former is called cationic electrodeposition coating, and the latter is called anionic electrodeposition coating. The cationic electrodeposition coating has been actively studied as a method for base coating for protecting car bodies from corrosion, and has been already used in industry.

Among paints to be used for such electrodeposition coating, a paint obtained by, for example, subjecting a resin having a molecular weight of 2000 to substitution with carboxyl groups to be water soluble is generally used as an anionic paint, and a paint obtained by subjecting its resin component to substitution with amino groups to be water soluble is generally used as a cationic paint. These paint resins exhibit a very low degree of ionization when dissolved in water. Therefore, the conductivity of an anionic paint in water is usually increased by adding a basic electrolyte (electrode solution) such as triethylamine, and the conductivity of a cationic paint in water is increased by adding an acidic electrolyte (electrode solution) such as acetic acid.

However, in a case where the conductivity of a paint solution is increased by adding an electrolyte (electrode solution), a paint resin component contained in the paint solution is reduced with the progress of electrodeposition coating treatment to the substrate. As a result, the concentration of amine, acetic acid or the like as an electrolyte (electrode solution) in the paint solution is increased so that there is a fear that problems such as remelting of a coating film and the occurrence of pinholes arise.

In order to solve such problems caused by an increased concentration of an electrolyte (electrode solution), an electrode device in which a tubular member for supporting a barrier membrane is concentrically arranged around the tubular electrode for electrodeposition coating at predetermined intervals, and at the same time, a barrier membrane, such as an ion exchange membrane, is wrapped around the exterior surface of the barrier membrane supporting member, and water is supplied into an annular gap formed between the electrode and the barrier membrane supporting member through the inside of the electrode to selectively introduce an electrolyte (electrode solution) present outside of the barrier membrane into the annular gap and discharge the electrolyte to the outside is disclosed in Patent Documents 1 and 2.

Patent Document 1: Japanese Patent Application Laid-open No. 5-195293

Patent Document 2: Japanese Patent Application Laid-open No. 2002-60997

By providing the barrier membrane in a tubular manner outside the tubular electrode, it is possible to avoid an increase in concentration of an electrolyte (electrode solution) caused by consumption of a paint resin contained in a paint solution, thereby eliminating various problems such as remelting of a coating film and the occurrence of pinholes caused by the increased concentration of an electrolyte. However, on the other hand, since the electrode device disclosed in Patent Documents 1 and 2 has a double structure in which the barrier membrane and the barrier membrane supporting member are arranged outside the tubular electrode at intervals, it is impossible to avoid the size of the electrode device becoming larger compared to that of the tubular electrode which is an electrode main body.

Further, since the electrode device needs the barrier membrane and the barrier membrane supporting member in addition to the tubular electrode which is an electrode main body, the number of components is increased, thereby making it impossible to avoid an increase in production cost.

Further, as another problem, there is a case where the barrier membrane, such as an ion exchange membrane, arranged outside the tubular electrode at intervals swells or extends in use. For this reason, there is a problem that wrinkles occur in the barrier membrane or it is impossible to firmly fix the barrier membrane to suppress the occurrence of wrinkles. It was a problem that the occurrence of wrinkles in the barrier membrane is a cause of retaining of a resin component contained in a paint solution in the wrinkles, which further causes coating defects such as pits and lumps.

In addition, as an electrode material for electrodeposition coating, an insoluble material in which platinum metal oxides or the like are supported to a valve metal, such as stainless steel, ferrite, or titanium is used. In the case of cationic electrodeposition coating, since an acidic electrode solution such as acetic acid, lactic acid, or formic acid is used as an electrolyte (electrode solution) contained in a paint solution, when using a stainless steel electrode as an electrode, the stainless steel slowly dissolves. As a result, it caused a problem that the electrode solution and an ion exchange membrane are contaminated or it is difficult to reuse the electrode solution. On the other hand, a ferrite electrode is brittle and therefore there was a problem that careful handling was required.

DISCLOSURE OF THE INVENTION

Problems to be Solved by the Invention

It is an object of the present invention to provide an electrode with a membrane for electrodeposition coating which is compact and economical and capable of avoiding upsizing and an increase in the number of components as much as possible caused by using a barrier membrane, such as an ion exchange membrane, in order to solve various problems such as a reduction in a paint resin with the progress of electrodeposition coating treatment and remelting of a coating film and the occurrence of pinholes caused by an increased concentration of an electrolyte as a result of the reduction.

It is another object of the present invention to provide an electrode with a membrane for electrodeposition coating capable of effectively preventing the deformation of the barrier membrane.

It is yet another object of the present invention to provide an electrode with a membrane for electrodeposition coating capable of preventing the contamination of the electrode solution and the barrier membrane and also reducing the environmental load by reusing the electrode solution.

Means for Solving the Problems

In order to achieve the objects, the electrode with a membrane for electrodeposition coating of the present invention includes an electrode main body in a hollow state made of a conductive material and configured so as to allow a liquid to pass through freely between the inside and outside of the electrode; and a barrier membrane, such as an ion exchange membrane, attached to the exterior surface of the electrode main body serving as a support.

In the hollow electrode with a membrane for electrodeposition coating according to the present invention, the hollow electrode main body is configured so as to allow a liquid to pass through freely between the inside and outside of the electrode, thereby serving also as a support of the barrier membrane, and the barrier membrane, such as an ion exchange membrane, is directly attached to the exterior surface of the electrode main body serving also as a support of the barrier membrane. Therefore, it is possible to collect a surplus electrolyte (electrode solution) contained in a paint solution into the electrode main body through the barrier membrane. In addition, there is no need of a specialized supporting member to maintain the barrier membrane on the outside of the electrode, thereby also eliminating an annular gap between the electrode and the supporting member.

In order to enhance the efficiency of collecting a surplus electrolyte (electrode solution) contained in a paint solution, the hollow electrode preferably has a structure such that material transfer between the inside and outside of the electrode is carried out only through the barrier membrane, and material transfer is not carried out through a portion other than the barrier membrane. Further, the hollow electrode preferably includes a forced liquid passing system for introducing a liquid into the electrode main body from the outside and discharging the liquid in the electrode main body to the outside: More specifically, the hollow electrode preferably has a configuration in which the both ends of the electrode main body are liquid-tightly closed with cap members and a liquid can be passed through inside of the electrode main body through an introduction nozzle and a discharge nozzle for a liquid provided on at least one of the cap members.

By circulating a low-concentration electrode solution or the like in the electrode main body through the introduction nozzle and the discharge nozzle, it is possible to enhance the efficiency of collecting an electrolyte into the electrode main body. For more smooth liquid circulation, the diameter of the discharge nozzle is desirably larger than that of the introduction nozzle.

It is preferred that the electrode main body is an insoluble electrode as a material, and in structure, it is preferable that the electrode main body has a mesh structure or a porous structure having both stiffness and liquid passing property, and in which openings for passing through the liquid are evenly distributed over the entire electrode main body. More specifically, a punched metal, an expanded metal, a metal mesh, or the like is preferable.

The insoluble electrode to be used as an electrode main body is preferably formed by coating the surface of a conductive substrate with an electrode active material mainly containing a platinum group metal. Here, the conductive substrate is preferably made of a valve metal such as titanium, tantalum, zirconium, or niobium or an alloy mainly containing valve metals, such as titanium-tantalum, titanium-niobium, titanium-vanadium, or titanium-tantalum-niobium. The conductive substrate may also be formed by coating the surface of a metal other than a valve metal such as iron or nickel, or a conductive ceramic with the valve metal, the alloy or a conductive diamond (e.g., a diamond doped with boron).

In the electrode active material coated onto the surface of the conductive substrate, a platinum group metal is preferably a mixed oxide obtained by mixing iridium oxide with tantalum oxide, titanium oxide, tin oxide or the like from the viewpoint of adhesiveness of a coated membrane. Particularly, iridium oxide mixed with tantalum oxide is most preferable because it can be used for a long period of time.

In the case where the electrode main body is used as an anode, hydrogen ions are generated due to oxygen evolution reaction as a main anodic reaction so that the acidity is increased and corrosion of the conductive substrate is likely to occur. For this reason, an intermediate layer, such as a tantalum metal thin membrane, showing excellent resistance to corrosion against an acidic electrolyte may be provided by a method such as sputtering between the conductive substrate and the mixed oxide coated membrane to prevent the corrosion of the electrode main body.

The barrier membrane to be attached to the exterior surface of the electrode main body serving as a support refers to a membrane having properties capable of generating a necessary difference in components between the inside and outside of the barrier membrane irrespective of whether the barrier membrane is hydraulically rough or tight, and a neutral barrier membrane may be used, but an ion exchange membrane is preferably used. Particularly, in the case where the electrode main body is used as an anode for cationic electrodeposition coating, an anion exchange membrane is preferably used. As the anion exchange membrane, a well known one can be used, but the one which can be firmly attached to the exterior surface of the electrode main body is preferably used. More specifically, an anion exchange membrane capable of being embedded in the opening of the electrode main body having a mesh structure or a porous structure to be attached by an anchor effect or an anion exchange membrane capable of being attached in a similar manner is preferably used. An example of an anion exchange membrane satisfying such requirements includes an anion exchange membrane AME (trade name) manufactured by AGC Engineering Co., Ltd.

It is also desired that the barrier membrane is attached to the exterior surface of the electrode main body with reinforcement by a reinforcing material. With such reinforcement, it is possible to prevent the barrier membrane from expanding and contracting in the longitudinal direction of the electrode main body in drying, immersing in a liquid, and using in a liquid. As the reinforcing material used herein, either one or a combination of two or more kinds of a nonwoven fabric, a porous body, a woven fabric, a mesh, a net, and a fibril can be used.

Effect of the Invention

Since the electrode main body serves as a support of the barrier membrane and the barrier membrane is directly attached to the exterior surface of the electrode main body, the hollow electrode with a membrane for electrodeposition coating according to the present invention is small and lightweight and is more easily handled as compared to an electrode having a double structure in which a barrier membrane is arranged outside of the electrode at intervals. Further, there is no need for a specialized support for the barrier member so that the number of components is reduced and therefore the hollow electrode is excellent in economic efficiency. From the viewpoint of the original function to solve various problems caused by an increased concentration of an electrolyte, the performance of the hollow electrode is comparable to that of an electrode having a double structure.

Further, by firmly attaching the barrier membrane to the exterior surface of the electrode main body by an anchor effect or the like, it is possible to suppress the extension of the barrier membrane in the longitudinal direction due to swelling and to suppress the occurrence of wrinkles. Therefore, it is possible to suppress the occurrence of retaining paint which is a cause of defective electrodeposition coating.

Further, by using an insoluble electrode as the electrode main body, it is possible to avoid the elusion of electrode materials into a paint solution and an electrode solution, thereby reducing the contaminations of the barrier membrane and the electrode solution. Further, the insoluble electrode can have a higher current density as compared to a stainless steel electrode, and therefore it is possible to reduce the time required for coating and the number of electrodes.

BRIEF DESCRIPTION OF THE DRAWING

FIG. 1 is a longitudinal sectional view of a hollow electrode with a membrane for electrodeposition coating according to one embodiment of the present invention.

| EXPLANATION OF REFERENCE NUMERALS | |
|---|---|
| 10 | electrode main body |
| 20 | barrier membrane |
| 30 | end cap |
| 40 | top cap |
| 50 | cap case |
| 60 | introduction nozzle |
| 61 | supply hose |
| 70 | discharge nozzle |
| 71 | discharge hose |
| 80 | filling material |
| 90 | terminal |
| 100 | power cable |

BEST MODE FOR CARRYING OUT THE INVENTION

Hereinbelow, an embodiment of the present invention will be described with reference to the accompanying drawing. FIG. 1 is a longitudinal sectional view of a hollow electrode with a membrane for electrodeposition coating according to one embodiment of the present invention.

The hollow electrode with a membrane according to this embodiment is used as, for example, a tubular anode for cationic electrodeposition coating. This hollow electrode includes a cylindrical electrode main body 10 provided vertically, a cylindrical barrier membrane 20 being in close contact with the exterior surface of the electrode main body 10 to support the electrode, an end cap 30 for closing the lower end of the electrode main body 10, a top cap 40 for closing the upper end of the electrode main body 10, and a sealing cap case 50 for covering the upper end of the electrode main body 10 together with the top cap 40.

The electrode main body 10 is a cylindrical body made of a valve metal such as titanium, and is constituted with a punched metal or the like having a large number of openings formed regularly. More specifically, the electrode main body 10 is constituted by molding a valve metal plate after being subjected to a process, such as a punching process, into a cylindrical shape. The surface of the electrode main body 10 is coated with an electrode active material such as iridium oxide mixed with tantalum oxide. A terminal 90 for connecting a power cable 100 is attached to the upper end of the electrode main body 10.

Herein, the cylindrical barrier membrane 20 supporting the electrode main body 10 is an anion exchange membrane, and is reinforced with, for example, a nylon mesh thermally fusion-bonded to one face or both faces of the barrier membrane 20. The barrier membrane 20 is then bonded by thermal pressure bonding or the like to the entire exterior circumference of the electrode main body 10 which is a support so that an anchor effect can be exhibited.

The end cap 30 is a thick disk made of a resin material, such as a vinyl chloride resin, having excellent acid resistance, and is designed to have a diameter larger than that of the barrier membrane 20 provided outside of the electrode main body 10. In the upper surface of the end cap 30, there is provided an annular groove in which the lower end of the electrode main body 10 is to be engaged. The lower end of the electrode main body 10 is engaged with the groove and is firmly fixed with an acid-resistant resin, such as an epoxy resin, thereby liquid-tightly sealing the lower opening of the electrode main body 10.

Like the end cap 30, the top cap 40 is a thick disk made of a resin material, such as a vinyl chloride resin, having excellent acid resistance, and is designed to have an outer diameter substantially the same as that of the barrier membrane 20 provided outside of the electrode main body 10. In the exterior surface of the lower end of the top cap 40, there is provided an annular cut in which the upper end of the electrode main body 10 is to be engaged. The upper end of the electrode main body 10 is engaged with the cut and is firmly fixed with an acid-resistant resin, such as an epoxy resin, thereby liquid-tightly sealing the upper opening of the electrode main body 10.

An introduction nozzle 60 and a discharge nozzle 70 are attached to the top cap 40 so as to penetrate the top cap 40 in a vertical direction in order that a liquid, such as an electrode solution, is passed through inside of the electrode main body 10. The upper end of the introduction nozzle 60 projects upward from the upper surface of the top cap 40, and the lower end extends to the vicinity of the lower end of the inside of the electrode main body 10. The discharge nozzle 70 has a diameter larger than that of the introduction nozzle 60. The upper end of the discharge nozzle 70 projects upward from the upper surface of the top cap 40, and the lower end is slightly inserted into the inside of the electrode main body 10. A supply hose 61 and a discharge hose 71 are attached to the introduction nozzle 60 and the discharge nozzle 70, respectively. The supply hose 61 and the discharge hose 71 need to have strength to some extent so that they are not easily bent. The hoses may also be reinforced with a reinforcing mesh to improve pressure resistance. Connections between the introduction nozzle 60 and the supply hose 61 and between the discharge nozzle 70 and the discharge hose 71 is preferably made within the cap case.

The cap case 50 is a cylindrical resin cover, and is provided over the top cap 40 so as to cover a joint between the electrode main body 10 and the top cap 40 in order to seal the joint between the electrode main body 10 and the top cap 40, each through hole for the introduction nozzle 60 and the discharge nozzle 70 and the like. The inside of the cap case 50 is filled with a filling material 80 such as an epoxy resin. The upper end of the supply hose 61 connected to the introduction nozzle 60 and the upper end of the discharge hose 71 connected to the discharge nozzle 70 project upward from the upper surface of the cap case 50 together with the power cable 100 connected to the terminal 90.

Hereinbelow, the usage and function of the hollow electrode with a membrane for electrodeposition coating according to this embodiment will be described.

In a case where the hollow electrode is used for, for example, cationic electrodeposition coating, the hollow electrodes are arranged along the both side walls of an electrodeposition bath containing a paint solution. In electrodeposition coating, the electrode main body 10 of the hollow electrode serves as an anode, and an object to be coated as a cathode is moved in the paint solution contained in the electrodeposition bath so as to pass through a space between the rows of the electrodes arranged on both sides, during which a positively-charged paint resin is deposited on the surface of the object to be coated. The degree of ionization of the paint resin is very low, and therefore an acidic electrolyte (electrode solution), such as acetic acid, is mixed with the paint solution.

The paint resin contained in the paint solution is consumed with the progress of electrodeposition coating so that the concentration of the acidic electrolyte (electrode solution) is increased. If such an increased concentration of the acidic electrolyte is left uncontrolled, a coating film is remelted or pinholes occur. Consequently, a low-concentration acidic electrolyte (electrode solution) is circulated in the electrode main body 10 of each of the hollow electrodes arranged along the inner surface of both side walls of the electrodeposition bath.

More specifically, the supply hose 61 is connected to the introduction nozzle 60 and the discharge hose 71 is connected to the discharge nozzle 70 to supply a low-concentration acidic electrolyte (electrode solution) into the electrode main body 10 through the introduction nozzle 60. With these connections, it is possible to discharge surplus acidic electrolyte ions contained in the paint solution in the electrodeposition bath into the acidic electrolyte (electrode solution) contained in the electrode main body 10 through the barrier membrane 20 formed from an ion exchange membrane. As a result, an increase in concentration of the acidic electrolyte (electrode solution) in the paint solution is suppressed. On the other hand, the acidic electrolyte (electrode solution) having an increased concentration is discharged from the electrode main body 10 to the outside through the discharge hose 71 connected to the discharge nozzle 70, and is then reused.

EXAMPLE

Finally, a hollow electrode with a membrane for electrodeposition coating according to the present invention was actually produced. A result of conducting a performance test will be described. The hollow electrode produced has a structure shown in FIG. 1.

On a titanium plate having a width of 100 mm, a length of 2540 mm, and a thickness of 1 mm, a large number of rhombic openings regularly arranged each having a LW of 6 mm and a SW of 3 mm were formed by punching. One surface of the punched metal was coated with an electrode active material, and this coating process was repeated five times.

More specifically, first a titanium plate as a raw material was washed to degrease, and then the entire surface of the titanium plate was subjected to blast treatment using #30 Alundum at a pressure of 0.4 MPa for about 10 minutes. The treated plate was washed in running water all day long, and was then dried. An electrode active material coating liquid having a liquid composition shown in Table 1 was applied onto the surface of the thus pretreated titanium plate, and the plate was then dried at 100° C. for 10 minutes and was further calcined in an electric furnace for 20 minutes.

The application of the electrode active material coating liquid, drying, and calcining were repeated five times to complete an electrode plate. In an electrode active material coating layer formed on one surface of the single electrode plate, a weight composition ratio of Ir/Ta was 7/3.

TABLE 1

| | |
|---|---|
| $TaCl_5$ | 0.32 g |
| $H_2IrCl_6 \cdot 6H_2O$ | 1.00 g |
| 35% HCl | 1.0 ml |
| $n\text{-}CH_3(CH_2)_3OH$ | 10.0 ml |

The electrode plate completed was formed into a cylindrical shape to obtain an electrode main body so that the electrode active material coating layer was an inner surface of the electrode main body. Then, a terminal for connecting a power cable was welded to one end in the direction of the center line of the electrode main body. An ion exchange membrane was bonded to the entire exterior surface of the produced cylindrical electrode main body by thermocompression at 150° C. for 10 minutes to obtain a cylindrical electrode with a membrane. The ion exchange membrane was the above anion exchange membrane AME (trade name) manufactured by AGC Engineering Co., LTd., and was reinforced with a nylon mesh bonded to both sides by thermocompression.

An end cap was firmly fixed to the lower end of the completed cylindrical electrode with a membrane with an epoxy resin, and a top cap was fixed to the upper end with an epoxy resin. An introduction nozzle and a discharge nozzle were attached to the top cap, and a supply hose and a discharge hose were attached to the introduction nozzle and the discharge nozzle, respectively. A power cable was connected to the terminal, and then a cap cover was attached to the cylindrical electrode tightly with an epoxy resin in such a manner that the top cap was completely hidden.

The thus obtained hollow electrode with a membrane was immersed in pure water heated to 50° C. overnight to swell the ion exchange membrane. The degree of expansion and contraction of the ion exchange membrane was determined. As a result, a change in the thickness direction of the ion exchange membrane was 1 mm, but no change was observed in the longitudinal direction, and further no wrinkles were observed.

Then, the hollow electrode with a membrane was immersed in a 1 mol/L acetic acid solution contained in a bath, and a current test was conducted at a current of 100 A using a stainless steel plate as a counter electrode. A 1 mol/L acetic acid solution was passed through inside the hollow electrode with a membrane at a flow rate of 200 L/h. The application of a current of 100 A and the liquid passing of the acetic acid solution at 200 L/h were carried out for 24 hours. As a result, the current efficiency was 90% and an increase in concentration of acetic acid was effectively suppressed. Further, no dimensional change was observed in the longitudinal direction of the cylindrical ion exchange membrane closely attached to the exterior surface of the electrode main body.

The invention claimed is:

1. A hollow electrode with a membrane for electrodeposition coating comprising:

an electrode main body in a hollow state made of a conductive material configured so as to allow a liquid to pass through freely between the inside and outside of the electrode; and a barrier membrane attached to the exterior surface of the electrode main body serving as a support.

2. The hollow electrode with a membrane for electrodeposition coating according to claim 1, wherein the barrier membrane is attached to the entire exterior surface of the electrode main body.

3. The hollow electrode with a membrane for electrodeposition coating according to claim 2, wherein the barrier membrane is firmly attached to the electrode main body by utilizing an anchor effect.

4. The hollow electrode with a membrane for electrodeposition coating according to claim 3, wherein the both ends of the electrode main body are closed so that material transfer between the inside and outside of the electrode is performed only through the barrier membrane, and material transfer is not performed through a portion other than the barrier membrane.

5. The hollow electrode with a membrane for electrodeposition coating according to claim 4, further comprising a forced liquid passing system for introducing a liquid into the electrode main body from the outside and discharging the liquid in the electrode main body to the outside.

6. The hollow electrode with a membrane for electrodeposition coating according to claim 5, wherein the both ends of said electrode main body are liquid-tightly closed with cap members, and wherein a liquid can be passed through inside of the electrode main body through an introduction nozzle and a discharge nozzle for a liquid provided on at least one of the cap members.

7. The hollow electrode with a membrane for electrodeposition coating according to claim 3, wherein said electrode main body has a mesh or porous structure.

8. The hollow electrode with a membrane for electrodeposition coating according to claim 3, wherein said electrode main body is an insoluble electrode.

9. The hollow electrode with a membrane for electrodeposition coating according to claim 3, wherein said barrier membrane is an ion exchange membrane or a neutral membrane.

10. The hollow electrode with a membrane for electrodeposition coating according to claim 3, wherein said barrier membrane is reinforced with a reinforcing material and is bonded to said electrode main body.

11. The hollow electrode with a membrane for electrodeposition coating according to claim 10, wherein said reinforcing material comprises either one or a combination of two or more kinds of a nonwoven fabric, a porous body, a woven fabric, a mesh, a net, and a fibril.

* * * * *